US008517712B2

(12) United States Patent
Gunter

(10) Patent No.: US 8,517,712 B2
(45) Date of Patent: Aug. 27, 2013

(54) ADJUSTABLE MOLD AND ASSOCIATED METHOD FOR MAKING A DRAINAGE CHANNEL

(75) Inventor: Charles E. Gunter, Mooresville, NC (US)

(73) Assignee: ABT, Inc., Troutman, NC (US)

( * ) Notice: Subject to any disclaimer, the term of this patent is extended or adjusted under 35 U.S.C. 154(b) by 501 days.

(21) Appl. No.: 12/154,052

(22) Filed: May 20, 2008

(65) Prior Publication Data

US 2009/0290935 A1 Nov. 26, 2009

(51) Int. Cl.
*B28B 7/02* (2006.01)

(52) U.S. Cl.
USPC ..... 425/330; 425/318; 425/DIG. 14; 425/DIG. 25

(58) Field of Classification Search
CPC ..... B28B 7/0044; B28B 7/0079; B28B 7/02
USPC ..... 425/87, 188, 318, 330, DIG. 14, 425/DIG. 25
See application file for complete search history.

(56) References Cited

U.S. PATENT DOCUMENTS

| | | | | |
|---|---|---|---|---|
| 4,630,966 | A * | 12/1986 | Karbstein | 405/118 |
| 5,106,231 | A | 4/1992 | Thomann | |
| 5,281,051 | A | 1/1994 | Stegall | |
| 5,348,421 | A | 9/1994 | Stegall | |
| 5,393,171 | A | 2/1995 | Stegall | |
| 5,482,248 | A | 1/1996 | Connors, Jr. | |
| 5,489,163 | A | 2/1996 | Thomann | |
| 5,653,553 | A | 8/1997 | Gunter | |
| 5,702,204 | A | 12/1997 | Gunter | |
| 5,788,996 | A | 8/1998 | Brouard | |
| 5,890,839 | A | 4/1999 | Gunter | |
| 6,170,796 | B1 | 1/2001 | Gunter | |

(Continued)

FOREIGN PATENT DOCUMENTS

| | | | |
|---|---|---|---|
| DE | 102005008819 | A1 | 9/2006 |
| FR | 2634234 | A1 | 1/1990 |

(Continued)

OTHER PUBLICATIONS

International Search Report for PCT/US2009/044702 dated Jan. 11, 2010.

(Continued)

*Primary Examiner* — Yogendra Gupta
*Assistant Examiner* — Alison Hindenlang
(74) *Attorney, Agent, or Firm* — Moore & Van Allen, PLLC

(57) ABSTRACT

Embodiments of the present invention allow for the manufacture of a number of drainage channels of different heights, widths, thicknesses, shapes, and slopes from only one mold or a greatly-reduced number of molds. In one embodiment, the drainage channel mold has an interior mold and an exterior mold. The exterior mold has two opposing sidewalls that can be placed at different distances apart from one another to vary the overall width of the drainage channel. The sidewalls can be independent of each other or they can be coupled to each other yet still allowed to be positioned at different distances apart. In one embodiment, the sidewalls are hingedly coupled to a base support mechanism. The mold also contains mold spacers that can be located between the interior mold and the exterior mold sidewalls to create different heights, widths, shapes, and slopes in the drainage channel walls formed by the adjustable mold.

14 Claims, 7 Drawing Sheets

(56) References Cited

U.S. PATENT DOCUMENTS

| | | | |
|---|---|---|---|
| 6,533,497 | B2 | 3/2003 | Gunter |
| 6,663,317 | B1 | 12/2003 | Williams et al. |
| 6,926,245 | B2 | 8/2005 | Wallace et al. |
| 7,172,368 | B2 | 2/2007 | Wallace et al. |
| 7,267,321 | B1 | 9/2007 | Morrell |
| 7,632,042 | B2 | 12/2009 | Brafford, Jr. et al. |

FOREIGN PATENT DOCUMENTS

| | | | | |
|---|---|---|---|---|
| JP | 07-068528 | | | 3/1995 |
| JP | 07068528 | A | * | 3/1995 |
| JP | 11188715 | A | * | 7/1999 |
| JP | 2001-003441 | A | | 1/2001 |
| JP | 2005-169739 | A | | 6/2005 |
| KR | 1020060102355 | | * | 9/2006 |
| WO | WO 97/02121 | A1 | | 1/1997 |
| WO | WO 2007/123329 | A1 | | 11/2007 |

OTHER PUBLICATIONS

International Preliminary Report on Patentability for PCT/US2009/044702 dated Dec. 2, 2010.

Extended European Search Report for European Patent Application No. 09751490.5 dated Feb. 20, 2012.

* cited by examiner

ADJUSTABLE MOLD AND ASSOCIATED METHOD FOR MAKING A DRAINAGE CHANNEL

FIELD

This invention relates generally to drainage channels and trench-forming adjustable molds, and to a method and system for using the adjustable molds to create different-sized drainage channels.

BACKGROUND

Drainage and other trenches of various sizes and shapes are desirable for a number of applications. For example, manufacturing facilities typically require drainage systems that include trenches formed in the building floors to collect, remove, and/or recycle excess water or other liquids. These trenches may also be used as utility chases to provide temporary or permanent routing of electrical lines, pipes, conduits or the like below the level of the building floor. In addition, numerous outdoor industrial and commercial sites, such as parking lots, also require drainage systems, including trenches, to collect and direct rainwater and other liquids to underground storm sewers to prevent flooding and to decrease run-off. Similarly, roadways and the like may also require drainage systems, including trenches.

In the past, these trenches have generally been formed by first placing and securing a form of predetermined shape in a ditch that has previously been formed in the ground. A moldable trench-forming composition, such as cementitious material, is then poured around the form and is allowed to set. Once the cementitious material has set, the form is removed from the resulting trench.

One type of form assembly used to define a trench includes a wooden form and strut structure. The wooden form includes a wooden frame which is covered with wooden sheets or planks to define a generally rectangular elongated trough. The wooden form is typically enclosed along its side and bottom faces, but may have an open top. Typically, a number of supporting wooden ribs are installed within the wooden form to increase the strength of the form so that it can withstand the relatively large pressures exerted by moldable trench forming compositions poured about it.

The wooden form is placed and secured within a preformed ditch. Cementitious material is typically poured up to the bottom face of the form and allowed to set in order to anchor the wooden form in the ditch. Then, additional cementitious material is poured between the earthen walls of the ditch and the wooden sides of the form. Once all of the cementitious material has set, the wooden form is disassembled and removed from the trench.

Wooden forms are generally formed of lumber having a relatively rough exterior texture. Correspondingly, the inside surface of the trench formed by the wooden form is relatively uneven which reduces the efficiency of the flow of liquid through the trench. In addition, the assembly and disassembly of the wooden forms is both costly and labor intensive. The relatively large cost and labor required for assembly and disassembly of the wooden forms is increased in the formation of long trenches, and even further increased in the formation of trenches having a pitched or slanted bottom surface to facilitate drainage.

Inexpensive forms are employed to form trenches instead of using the wooden forms discussed above. These trench-forming assemblies preferably include opposing longitudinal frame members having a plurality of anchoring rods extending downwardly from the frame members. An elongated form body, preferably formed of relatively lightweight expanded polystyrene, includes aligned longitudinal slots in the opposed side walls for receiving the frame members. Horizontal portions of the frame members are secured within the longitudinal slots in the sidewalls of the form body during formation of the trench so that the frame members are held in alignment during the trench forming operation.

Preferably the assembled form and frame members are placed into a prepared ditch by suspending the assembly from its top, such as by one or more batter boards. Cementitious material is first poured around the bottom of the anchoring legs attached to the frame members and allowed to set in order to secure the anchoring legs and, in turn, the frame members and the form within the ditch. Then more cementitious material is poured around the form body and allowed to set. Finally the form body is removed to expose the resulting trench and the properly aligned frame members. The removal of the form may be facilitated by a pair of slots extending upwardly into the form body from its bottom surface. By removing an upper portion of the form to access the slots, the form body can be more easily removed from the trench in several pieces.

Drainage channels may also come preformed and assembled on site from a series of discrete drainage channel sections which form and provide a chemical resistant liner in the trench. A first step in installing such a drainage channel is placing the drainage channel sections in an end-to-end relationship at the proper depth below the desired level of the surface. In this regard, a trench may be formed to the desired depth adjacent to the surface for receiving the channel sections. Alternatively, the entire area below the surface may be graded to the desired depth and various subsurface layers can then be placed thereon.

The adjacent ends of two adjoining drainage channel sections may have interlocking end surfaces and may be supported on a single support brick which has been aligned and secured before placement of the drainage channel sections. It is important that the channel sections be supported in such a manner that the channel sections are precisely aligned so as to ensure proper drainage, to permit the grate to seat properly over the open top of the drainage channel, and to prevent adjoining channel sections from being misaligned so as to create a potential trip hazard for people. This proper alignment of the drainage channel sections can be thwarted even if the support bricks are properly aligned if the drainage channel sections and, more particularly, the respective lower surfaces of the drainage channel sections which are seated upon the support bricks are not properly formed in a predetermined aligned relationship. Once the adjoining drainage channel sections have been interlocked, however, the adjacent ends of the sections may be sealed with an adhesive or sealant to prevent leakage.

Once the drainage channel sections are interlocked in an end-to-end relationship, the lower portions of the drainage channel sections are typically encased in concrete so as to secure the channel.

Regardless of the fabrication technique, it is normally desirable to finish the trench with an elongated grate covering its open top in order to prevent people from unwittingly stepping in the open trench, to provide a smooth surface for vehicle travel, and/or to prevent relatively large objects from entering the trench and potentially blocking the flow of liquid therethrough. The grate is generally supported by a pair of spaced apart frame members which are set into and extend from the walls of the concrete trench. In order to stabilize the grate and to prevent the grate from rocking when weight, such as from a passing vehicle, is applied thereto, the frame members must be aligned in a common plane during the pouring and setting of the concrete about the form. If the frame members and, in turn, the grate are not properly aligned, the grate, the frame members and/or the cementitious trench itself may be damaged by the resulting movement of the grate. Accordingly, the alignment of the frame members in the moldable trench forming composition is important.

The problem with the pre-formed drainage channels is the fact that customized molds must be made for each new customer who needs drainage channels of different widths, depths, thicknesses, and slopes. A new custom mold has to be created for each customer based on the particular customer's requirements and on the application for which the drainage channel is going to be used. In many cases each individual customer themselves will have a need for a number of different molds, one for each individual section of the drainage channel that has a different depth or slope in its walls. The cost of building, maintaining, and storing a lot of molds, many of which are only used once, is significant. Therefore it is desirable to control and reduce the number of molds that must be created.

BRIEF SUMMARY

Embodiments of the present invention allow for the manufacture of a number of drainage channels of different heights, widths, thicknesses, shapes, and slopes from only one mold or a greatly-reduced number of molds. Embodiments of the present invention facilitate the manufacturing of custom channels at low cost by reducing the need to develop and store individual molds for each type of drainage channel.

In one embodiment, the drainage channel mold has an interior mold and an exterior mold. The exterior mold has two opposing sidewalls that can be placed at different distances apart from one another to vary the overall width of the drainage channel. The sidewalls can be independent of each other, or they can be coupled to each other yet still allowed to be positioned at different distances apart. Alternatively, one sidewall can be fixed while the other can be positioned at different distances relative to the fixed sidewall. In another embodiment the sidewalls are coupled to a base support that braces the mold assembly. The base support helps hold the mold assembly together when in use and allows the mold assembly to be positioned in different locations to facilitate its use.

The exterior mold also has two opposing endwalls. In one embodiment the endwalls are independent of the rest of the mold. In another embodiment the endwalls are coupled to the base support. In one embodiment, one endwall has an embossed edge and the other endwall has a recessed area around the periphery, which creates tongue and groove channels on opposite ends of the drainage channel for assembly with other sections during installation.

The interior mold can be switched out of the assembly to change the thickness and internal shape of the drainage channel. In one embodiment of the invention the interior and exterior molds create no ribs in the sidwalls. This configuration results in reduced stress concentration in the drainage channel, which reduces the material cost to obtain the same strength in the drainage channel. Additionally, the molds can be configured to introduce a tapered thickness in the sidewalls to provide strength where needed in the drainage channel, which again reduces the material cost.

One embodiment of the mold is an assembly configuration that contains mold spacers located between the interior mold and the exterior mold sidewalls. Different types of mold spacers can be introduced to the mold to create different heights, widths, shapes, and slopes in the walls of the drainage channel formed from the adjustable mold. Another embodiment contains adjustable mold spacers. In such an embodiment, the mold spacers can be adjusted along the axis of the side walls to vary the height of the drainage channel on either one or both sides of the channel. In another embodiment the opposing ends of each mold spacer may be movable relative to each other in order to create a drainage channel with a sloped height. The sloped height allows for the movement of water from one end to the other or is helpful for installation in sloped terrain.

In one embodiment, the mold spacers have recesses for attaching inserts. When material is poured into the mold the inserts create recesses in the edges of the drainage channel walls. In one embodiment these recesses in the edges of the drainage channel provide attachment locations for the grate coverings once the drainage channel is installed into the ground.

The drainage channel mold of the present invention can therefore use the same exterior mold with a number of exchangeable interior molds to vary the width, height, thickness, internal surface, and slope of the drainage channels. Alternatively, or in addition to exchanging the interior molds, the mold spacers can be replaced or adjusted to vary these characteristics of the drainage channels. Therefore, using embodiments of the present invention, customized drainage channels can be made for a number of different applications without having to develop, procure and store customized molds for each new application, thus, saving time and money in the development of customized drainage channels.

In this regard, embodiments of the present invention also provide methods of making drainage channel sections of various sizes, shapes, or slopes. For example, in one embodiment, the method involves the steps of: (1) providing an adjustable mold having an interior mold portion and an exterior mold portion at least partially surrounding said interior mold portion; (2) using the adjustable mold to form a first drainage channel section; and (3) using at least the exterior mold portion from the adjustable mold to form a second drainage channel section having a size, shape, or slope that is different from the first drainage channel section. In one embodiment, using at least the exterior mold portion from the adjustable mold to form a second drainage channel section involves using both the exterior and interior portions of the adjustable mold to form the second drainage channel section having a size, shape, or slope that is different from the first drainage channel section. In another embodiment, however, the method may involve providing a second interior mold portion that is different from the first interior mold portion and using the second interior mold portion in conjunction with the exterior mold portion instead of the first interior mold portion so that the exterior mold portion at least partially surrounds the second interior mold portion.

As described above, in some embodiments of the invention the adjustable mold includes first and second opposing sidewalls supported by a base support, where the first sidewall is hingedly coupled to a first portion of the base support, the second sidewall is hingedly coupled to a second portion of the base support, and the base support is structured such that the first portion of the base support can move relative to the second portion of the base support to allow the first sidewall to be moved towards or away from the second sidewall. In such an embodiment, the process of using at least the exterior mold portion from the adjustable mold to form a second drainage channel section may further involve moving the first sidewall relative to the second wall so that the second drainage channel has a width that is different from the width of the first drainage channel.

As also described above, some embodiments of the invention the include mold spacers that define a distance between said exterior mold portion and the first or second interior mold portions, and define the upper edge of walls of the drainage channel sections. Where these mold spacers are adjustably moveable relative to the interior and exterior mold portions, the process of using at least the exterior mold portion from the adjustable mold to form a second drainage channel section may further involve moving the mold spacers relative to the exterior mold portion so that the second drainage channel has a height that is different from the height of the first drainage channel. Alternatively or additionally, the process may also involve changing the slope of the mold spacers relative to the exterior mold portion so that the second drainage channel has a slope that is different from the slope of the first drainage channel. In other embodiments, however, the process involves replacing the original mold spacers used in the adjustable mold to make the first drainage channel section with mold spacers that are different in size or shape than the original mold spacers.

BRIEF DESCRIPTION OF THE DRAWINGS

Figure 1:
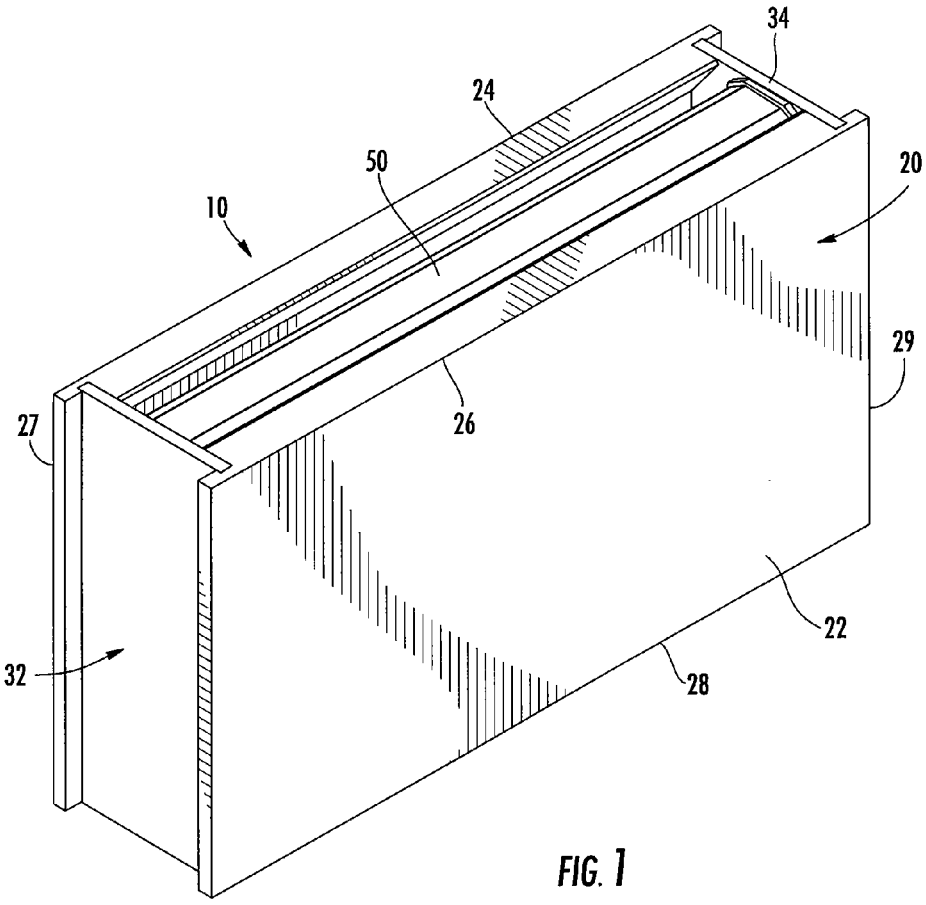
Figure 2C:
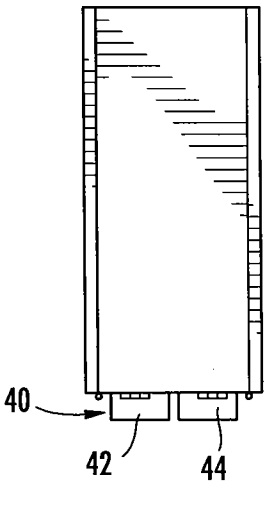
Figure 2A:
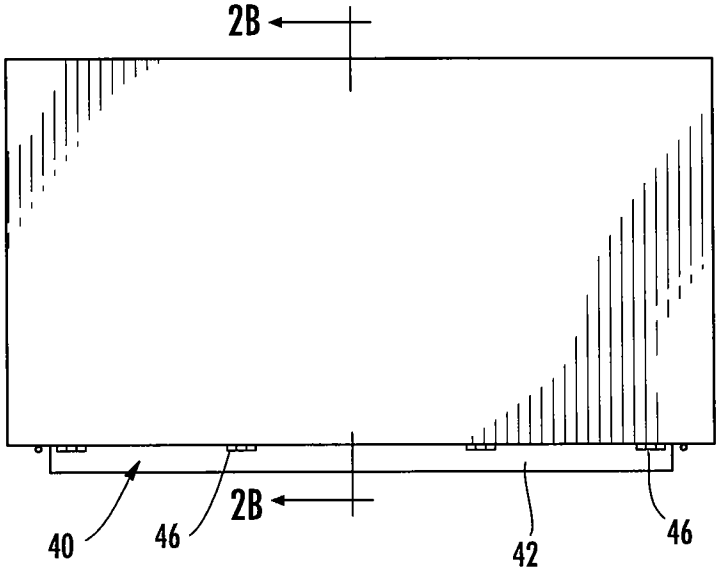
Figure 2B:
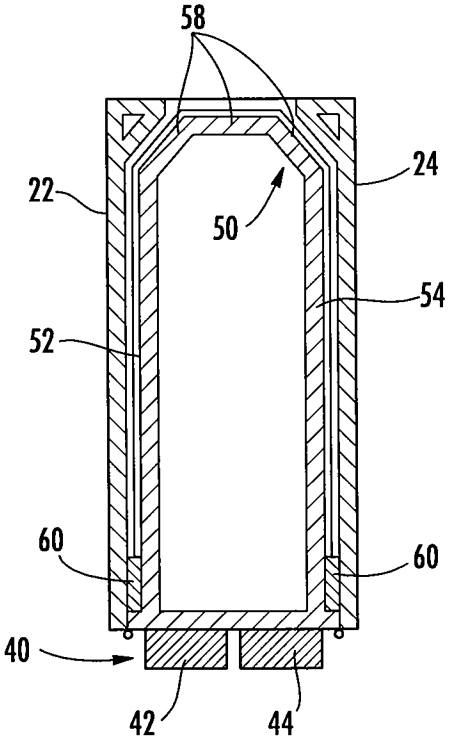
Figure 3A:
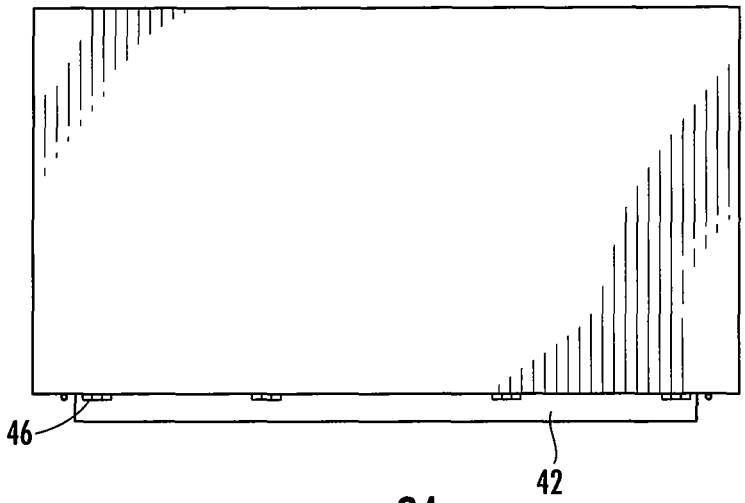
Figure 3B:
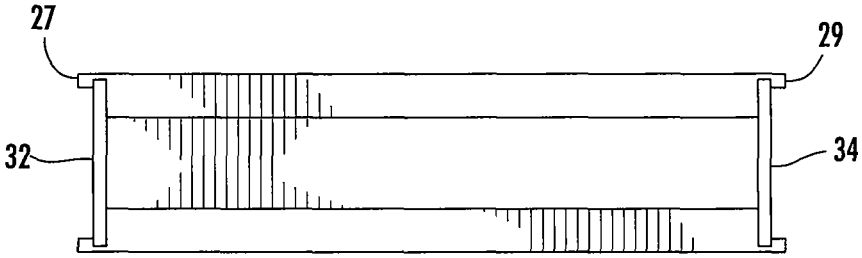
Figure 3C:
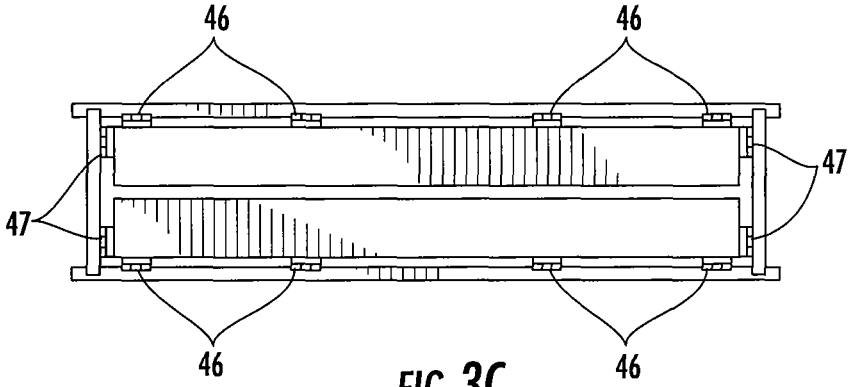
Figure 4:
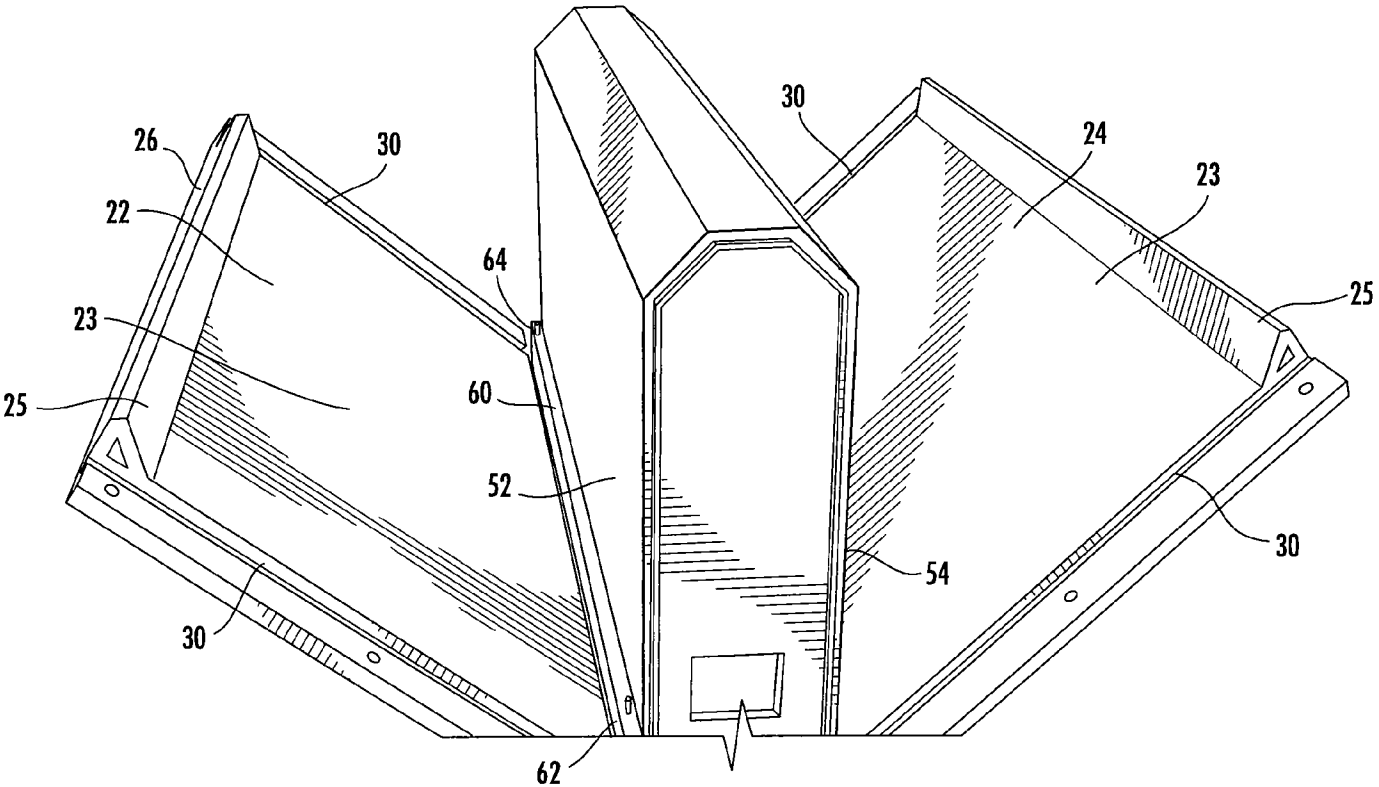
Figure 5B:
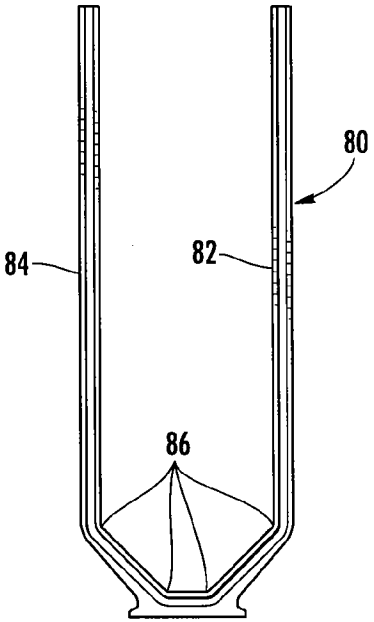
Figure 5A:
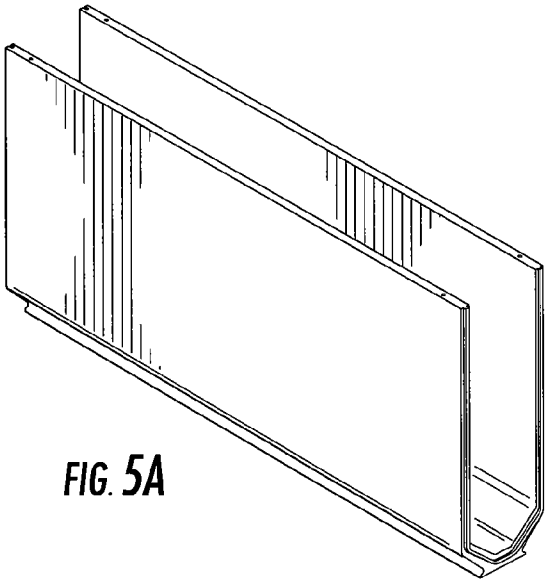
Figure 5C:
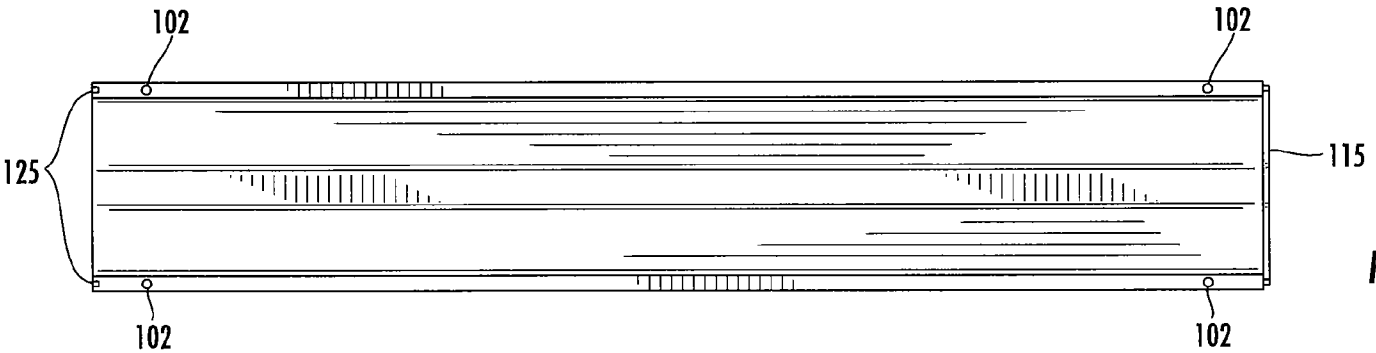
Figure 6:
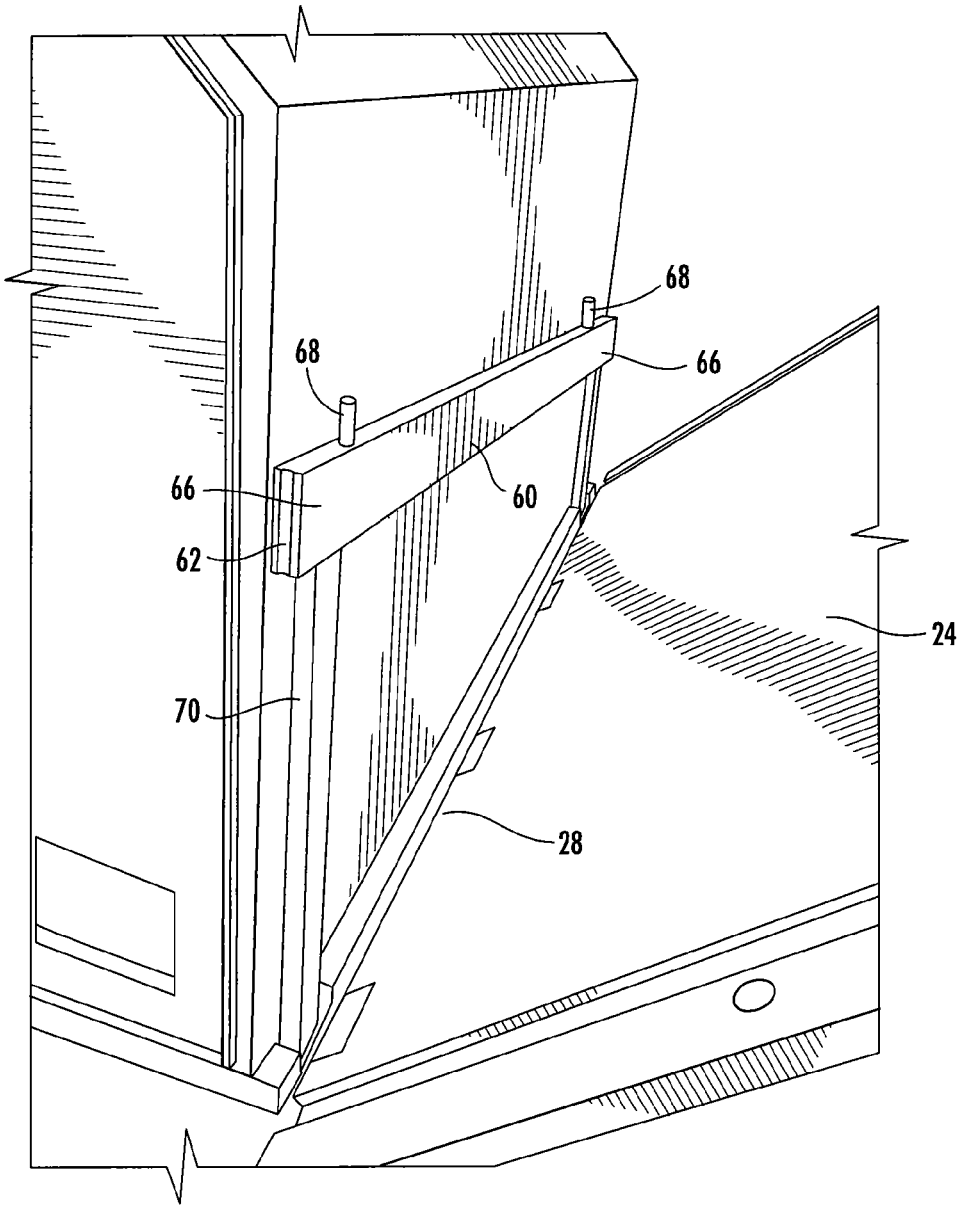
Figure 7:
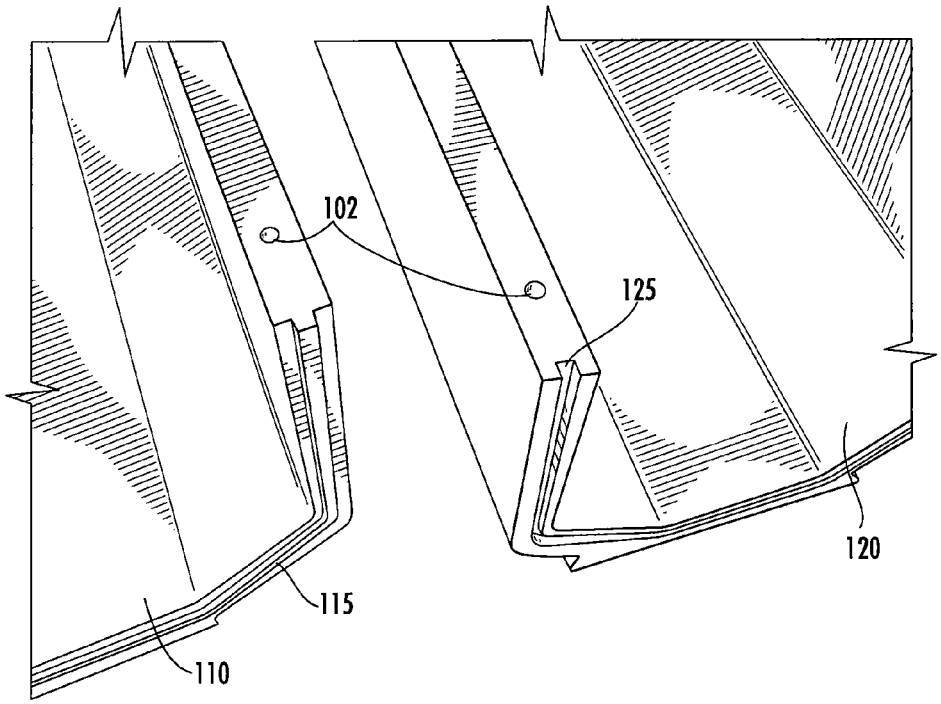

Having thus described embodiments of the invention in general terms, reference will now be made to the accompanying drawings, which are not necessarily drawn to scale, and wherein:

FIG. 1 illustrates an isometric plan view of an assembled adjustable drainage channel mold configured in accordance with an embodiment of the present invention;

FIG. 2(*a*) is a side view of the adjustable mold of FIG. 1 in accordance with an embodiment of invention;

FIG. 2(*b*) is a cross-sectional view of the adjustable mold of FIG. 2(*a*) illustrating the cavity created by the assembled adjustable mold in accordance with an embodiment of the invention;

FIG. 2(*c*) is an end view of the adjustable mold of FIG. 2(*a*) in accordance with an embodiment of the present invention;

FIG. 3(*a*) is a side view of the adjustable mold of FIG. 1 in accordance with an embodiment of the invention;

FIG. 3(*b*) is a top view of the adjustable mold of FIG. 3(*a*) illustrating where the material is poured into the mold which then hardens to created the drainage channel in accordance with another embodiment of the present invention;

FIG. 3(*c*) is a bottom view of the adjustable mold of FIG. 3(*a*) illustrating the base members attached to the opposing side walls and supporting the assembly of the adjustable mold in accordance with an embodiment of the present invention;

FIG. 4 illustrates an isometric view of an adjustable drainage channel with the opposing sidewalls in an open configuration in accordance with an embodiment of the present invention;

FIG. 5(*a*) is an isometric view of the drainage channel created by one embodiment of the present invention;

FIG. 5(*b*) is a front view of the drainage channel of FIG. 5(*a*) created by one embodiment of the present invention and illustrates an embodiment of the drainage channel having walls with no ribs, thicker drainage base walls, and a shape that reduces the stress concentration in the drainage channel walls;

FIG. 5(*c*) is a top view of the drainage channel of FIG. 5(*a*) illustrating the tongue and groove edges of the drainage channel formed by the endwalls of the mold assembly in accordance with one embodiment of the present invention;

FIG. 6 illustrates an isometric view of one side of the adjustable mold showing one sidewall of the outer mold, the inner mold, and the spacers in accordance with an embodiment of the present invention; and FIG. 7 is an isometric view of an embodiment of the drainage channel illustrating the tongue and groove edges of the drainage channel formed by the mold endwalls, and the insert recesses used for assembly during installation of the drainage channel formed by the mold assembly spacers and inserts.

DETAILED DESCRIPTION OF THE PREFERRED EMBODIMENTS

Embodiments of the present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Referring to the drawings, FIG. 1 illustrates an adjustable mold 10 for a drainage channel in its assembled configuration before the introduction of the molding material. The adjustable mold 10 has an exterior mold 20 and an interior mold 50. The exterior mold 20 is made up of two sidewalls 22 and 24, two endwalls 32 and 34, and a base support 40 (visible in FIG. 2). The sidewalls 22 and 24 have a leading end 26 and a trailing end 28. In one embodiment of the invention the sidewalls 22 and 24, endwalls 32 and 34, and/or base support(s) 40 are not coupled to one another and some or all of these portions of the mold may move independently of each other. As described in greater detail below, in other embodiments, the sidewalls 22 and 24, endwalls 32 and 34, and/or base support(s) 40 are coupled to one another, but are coupled to one another by mechanisms that allow a user to move some or all of these portions of the mold relative to each other. In still other embodiments, some or all of these portions of the mold may be coupled to and fixed relative to the other portions of the mold.

In the illustrated embodiment, the sidewalls are able to be positioned at different distances relative to each other, which gives the adjustable mold 10 the flexibility to change the overall width of the drainage channels and/or the width of the drainage channel walls. In one embodiment of the invention each of the sidewalls 22 and 24 may be of integral unitary construction with the base support(s) 40, but still capable of being positioned at different distances from each other through adjustment mechanisms in the base support 40.

In another embodiment, the sidewalls 22 and 24 may be coupled to each other and the base support 40 through their trailing ends 28. However, despite being coupled to the base support 40 the sidewalls 22 and 24 may still have the ability to be positioned at various distances relative to each other through adjustment mechanisms in the base support 40.

For example, as illustrated in FIGS. 2(*a*)-2(*c*),in one embodiment the trailing ends 28 of the sidewalls 22 and 24 are fixed to the base support 40 using any of a variety of techniques known in the art, such as hinges 46, screws, nails, glue, etc. In such an embodiment, the base support 40 may be made up of at least two base members 42 and 44 that are coupled to the two sidewalls 22 and 24, respectively. The two base members 42 and 44 may be configured to move relative to each other to control the width of the drainage channel and/or the channel walls. In other words, moving the two base members 42 and 44 away from each other may cause the two sidewalls 42 and 44 coupled thereto to move away from each other, thereby causing the width of the channel and/or the width of the channel walls to be increased. Moving the two base members 42 and 44 towards each other may cause the two sidewalls 42 and 44 coupled thereto to move towards each other, thereby causing the width of the channel and/or the width of the channel walls to be decreased.

In one embodiment, the two base members 42 and 44 are not coupled to each other and are held in place relative to each other merely by the weight or shape of the interior mold 50. In another embodiment, the two base members 42 and 44 are coupled to each other by a mechanism, such as one or more track systems, that allows the two base members 42 and 44 to slide towards and away from each other. Such a mechanism may include one or more locking mechanisms, such as a bolt and wing nut placed in a track, which allows a user to lock the two base members 42 and 44 relative to each other. Different types of mechanisms for allowing the two (or more) base members 42 and 44 to move towards and/or away from each other and for selectively locking the two (or more) base members 42 and 44 relative to each other will be apparent to one of ordinary skill in the art in view of this disclosure.

In still other embodiments of the invention, one or both of the sidewalls 22 or 24 are coupled to the base support 40, but coupled in such a way that one or both of the sidewalls 22 or 24 may be moved relative to the base support 40. Various mechanisms for coupling a sidewall to the base support such that the sidewall can move towards and away from the base support will be apparent to one of ordinary skill in the art in view of this disclosure.

FIGS. 3(*a*) and 3(*c*) illustrate one exemplary embodiment of the invention where the sidewalls 22 and 24 are hingedly connected to the base members 42 and 44 of base support 40 through hinges 46. In this embodiment the sidewall 22 is coupled to base member 42 and sidewall 24 is coupled to base member 44. Therefore, the opposing sidewalls and bases may be placed at different distances from each other, while still allowing the leading end 26 and trailing end 28 of the sidewalls to move independently of each other. As described below, this type of hinged configuration may be useful to create drainage channels with walls that get increasingly thicker as the wall approaches the bottom of the channel and/or for removing the drainage channel from the mold.

Two endwalls 32 and 34 are located at the proximal end 27 and distal end 29 of the sidewalls 22 and 24 to enclose the interior mold 50. The endwalls may be independent of the rest of the mold, or they may be coupled to the base support 40 or the interior mold 50. In FIG. 3(*c*) the endwalls 32 and 34 are hingedly connected to the base support 40 by hinges 47. This hinged configuration may be useful to adjust the slope of the ends of the drainage channels relative to the top and bottom of the drainage channel and/or for aiding in the removal of the drainage channel from the mold. As also illustrated in FIG. 3, in one embodiment, the endwalls 32 and 34 are contained within notches 30 in the sidewalls 22 and 24 of the exterior mold.

FIG. 2(*b*) and FIG. 4 illustrate the interior mold 50 in accordance with an embodiment of the present invention. Interior mold 50 has two interior mold sides 52 and 54, an interior mold base 56, and an internal shaping surface 58 that defines the internal surface of the lower portion of the drainage channel. In one embodiment the interior mold base 56 extends beyond the interior mold sides 52 and 54 and contacts the interior surface 23 of the exterior mold's sidewalls 22 and 24. In one embodiment the internal shaping surface 58 is a half circle-like configuration comprised of three planar sides. This design reduces the stress concentration in the drainage channel 80 illustrated in FIG. 5. Specifically, stress is reduced in the corners 86 of the internal drainage surface 82, as illustrated in FIG. 5(*b*), compared to the stress concentration in the corners of a traditional rectangular channel. Any number of internal drainage surfaces 82 can be defined by changing the internal shaping surface 58 of the interior mold 50. In this regard, in other embodiments the internal shaping surface 58 includes a circular or parabolic curve, or may comprise more than three planar sides.

FIG. 2(*b*) and FIG. 4 also illustrate how the external drainage channel surface 86 is defined by the internal surfaces 23 of the sidewalls 22 and 24 and the external shaping surfaces 25 located on the leading end 26 of the sidewalls 22 and 24. In one embodiment the internal surfaces 23 are smooth planes and, as such, the drainage channel has no ribs, which may reduce the stress concentration in the drainage channel. However, the internal surfaces 23 could be changed to include one or more ribs or other features in the external surface of the drainage channel. The external shaping surface 25 may also be altered to create different shapes in the base of the drainage channel 80. In one embodiment there is a slope on the external shaping surface 25, allowing the thickness of the drainage channel base 88 to be increased in the areas of the higher stress concentration, thus minimizing the use of the materials and reducing the cost of the drainage channel. A tapered thickness of the drainage channel walls can be created by changing the internal mold or by changing the distance between the leading ends 26 of the sidewalls 22 and 24, while keeping the trailing end 28 the same distance apart.

As shown in FIGS. 2(*b*) and 4, in one embodiment, spacers 60 are added between the sidewalls 22 and 24 of the exterior mold 20 and the interior mold sides 52 and 54 of the interior mold 50. The spacers 60 define the location of the upper edges of the drainage channel walls and, as such, determine the height of the drainage channel walls. Different sized spacers 60 may be substituted to change the height of the drainage channel. In some embodiments, spacers that have a proximal end 62 and distal end 64 of different heights may be used to change the slope of the upper edge of the drainage channel walls relative to the slope of the bottom of the drainage channel. In this way, a user can easily change the slope of the drainage channel relative to the surface that the channel will be installed in by changing the slope of the upper edges of the drainage channel and then aligning the upper edges of the drainage channel with the surface that the channel is being installed in. The spacers 60 may also be used to define the space between the interior mold 50 and the sidewalls 22 and 24, thereby defining the thickness of the drainage channel walls.

In another embodiment, as shown in FIG. 6 the spacers 60 are attached to a positioning mechanism 70 to change the location of the spacer relative to the leading end 26 and trailing end 28 of the sidewalls 22 and 24. In some embodiments the proximal end 62 and distal end 64 of the spacer 60 can move relative to one another in order to change the slope of the drainage channel relative to the upper edges of the drainage channel walls, which would help collect, remove, and/or recycle excess water or other liquids along its length or help to take into account sloping terrain where the drainage channel is being installed.

In one embodiment, the positioning mechanism 70 includes a screw, as shown in FIG. 6, that extends between the spacer 60 and the base support 40 on each end of the spacer 60. Each screw may be structured such that it can be screwed more or less through the base support 40 or the spacer 60 to increase or decrease the height of the corresponding end of the spacer 60. In other embodiments, the positioning mechanism 70 uses other mechanisms for changing the distance between the ends of the spacers 60 and the base support 40 that will be apparent to one of ordinary skill in the art in view of this disclosure. For example, in one embodiment the positioning mechanism 70 comprises a plurality of interlocking pieces that can be stacked on top of each other to incrementally change the distance between the spacer 60 and the base support 40.

In some embodiments, the spacers 60 are adapted to have inserts 68, or other protrusions, extending therefrom into the cavity between the interior and exterior molds, as seen in FIG. 6. When the molded material is poured into the adjustable mold cavity, the inserts 68 create recesses 102 in the mold material at the upper edges of the drainage channel walls, as illustrated in FIG. 5(*c*). In one embodiment these recesses 102 are used for positioning during installation and for the attachment of protective grates, tops, or frame that cover the drainage channel. FIG. 6 illustrates one embodiment where recessed pin locations 66 are provided in the spacers 60. The pin locations are shaped to enable the attachment of inserts 68, such as pins, to the spacer 60. The inserts then leave recessed cavities, such as cylindrical cavities, in the drainage channel, thus providing an attachment point for the grate covers. Although removable inserts 68 may provide for increased flexibility and customization of the mold, in other embodiments, instead of inserts 68, the spacers 60 have protrusions extending therefrom that are integrally formed with or otherwise fixed to the spacer 60.

FIG. 7 illustrates the ends of two exemplary drainage channel sections 110 and 120 that were formed using embodiments of the molds and procedures described herein. FIG. 7 illustrates the recesses 102 in the top of the drainage channel walls that are formed from the inserts 68 or other protrusions extending from the spacers 60.

In some embodiments of the invention, the one endwall 32 of the mold has a protrusion around its periphery, the protrusion extending from the endwall 32 into the cavity between the interior and exterior sidewalls of the mold. Such a protrusion creates a groove or other recess in one end of the drainage channel section formed from the mold, such as the U-shaped groove 125 in the end of the drainage channel section 120 illustrated in FIG. 7. In such embodiments, the other endwall 34 of the mold generally has a recessed area around its periphery to create a tongue or other protrusion in the other end of the drainage channel section formed from the mold, such as the U-shaped tongue 115 in the end of the drainage channel 110 illustrated in FIG. 7. These tongues and grooves are sized such that the groove in the end of one drainage channel section can receive the tongue in the end of an adjacent drainage channel section to interlock the two sections together in an aligned relationship.

Specific embodiments of the invention are described herein. Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. An adjustable mold for making drainage channel sections of various sizes, shapes, or slopes, the adjustable mold comprising:

an interior mold portion, said interior mold defining a base;

a base support that interfaces with said base of said interior mold portion; and an exterior mold portion at least partially surrounding said interior mold portion to thereby define a mold, said exterior mold portion comprising:

first and second opposing sidewalls comprising a distal end and a proximal end, wherein the adjustable mold is structured so that at least said first sidewall is positionable at various distances apart from said second sidewall in order to change the overall width of the drainage channel, wherein the first sidewall is coupled to a first portion of the base support, wherein the second sidewall is coupled to a second portion of the base support, and wherein the base support is structured such that the first portion of the base support can move relative to the second portion of the base support to allow the first sidewall to be moved towards or away from the second sidewall;

first and second opposing endwalls, wherein said first endwall is located at the proximal end of said first and second opposing sidewalls and said second endwall is located at the distal end of said first and second opposing sidewalls;

at least one mold spacer located between said interior mold and at least one of said first and second opposing sidewalls of said exterior mold, said mold spacer defining first and second ends; and at least one positioning mechanism structured to allow at least one of said first and second ends of said mold spacer to be positioned at different heights along said at least one of said first and second opposing sidewalls of said exterior mold, wherein said at least one positioning mechanism comprises at least two elongate members extending between said base support and said mold spacer, each of said at least two elongate members being structured such that the length of each elongate member extending between said base support and said mold spacer is adjustable, wherein at least one of said base support and said mold spacer defines an aperture that is structured to threadably receive an end of at least one of said at least two elongate members.

2. The adjustable mold of claim 1, wherein said first and second opposing sidewalls each have a leading and trailing end, wherein the adjustable mold is structured such that said leading and trailing ends of said first opposing sidewall are capable of moving independently of said leading and trailing edges of said second opposing sidewall.

3. The adjustable mold of claim 1, wherein said base defines a distance between said first and second opposing sidewalls of said outer mold.

4. The adjustable mold of claim 1, wherein said first opposing endwall is grooved so as to provide a tongue on the proximal end of the drainage channel, wherein said second opposing endwall has a tongue so as to provide a groove in the distal end of the drainage channel, and wherein the drainage channel has the ability to mate with an additional drainage channel using the tongue or groove in the proximal or distal ends of the drainage channel.

5. The adjustable mold of claim 1, further comprising a mold spacer located between said interior mold and each of said first and second sidewalls, each mold spacer defining the top edge of a drainage channel wall, wherein at least one mold spacer has at least one protrusion extending therefrom into a region between the interior mold portion and one of the sidewalls of the exterior mold portion so that a cavity is formed in the top edge of the drainage channel wall to facilitate securing a frame or grate assembly to the drainage channel.

6. The adjustable mold of claim 1, further comprising a second interior mold portion having a size or shape that is different than the size or shape of the first interior mold portion, wherein the second interior mold portion is structured so that it can be used with the exterior mold portion to form a drainage channel that is different in size or shape from the drainage channel formed by the first interior mold portion.

7. An adjustable mold for making drainage channel sections of various sizes, shapes, or slopes, the adjustable mold comprising:

an interior mold portion, said interior mold defining a base;

a base support that interfaces with said base of said interior mold portion; and an exterior mold portion at least partially surrounding said interior mold portion to thereby form a cavity so as to define a mold, said exterior mold portion comprising:

first and second opposing sidewalls each having a proximal end and a distal end, wherein the first sidewall is coupled to a first portion of the base support, wherein the second sidewall is coupled to a second portion of the base support, and wherein the base support is structured such that the first portion of the base support can move relative to the second portion of the base support to allow the first sidewall to be moved towards or away from the second sidewall;

first and second opposing endwalls, wherein said first endwall is located at the proximal end of said first and second opposing sidewalls and said second endwall is located at the distal end of said first and second opposing sidewalls;

at least one mold spacer located between said interior mold portion and said exterior mold, wherein the mold spacer defines a distance between the interior mold portion and the first or second sidewall, said mold spacer defining first and second ends, and wherein the mold spacer defines an upper edge of a drainage channel section; and at least one positioning mechanism structured to allow at least one of said first and second ends of said mold spacer to be positioned at different heights along said at least one of said first and second opposing sidewalls of said exterior mold, wherein said at least one positioning mechanism comprises at least two elongate members extending between said base support and said mold spacer, each of said at least two elongate members being structured such that the length of each elongate member extending between said base support and said mold spacer is adjustable, wherein at least one of said elongate members is comprised of a plurality of interlocking, stackable portions.

8. The adjustable mold of claim 7, wherein the at least one mold spacer is adjustably movable relative to the interior mold portion to adjust the height of the drainage channel wall.

9. The adjustable mold of claim 7, wherein opposing ends of the at least one mold spacer are movable relative to each other to change the slope of the mold spacer, so as to change the slope in the drainage channel.

10. The adjustable mold of claim 7, wherein the at least one mold spacer has a recess for attaching at least one insert, wherein said insert forms a cavity in the drainage channel for the attachment of a frame or grate assembly.

11. The adjustable mold of claim 7, wherein the at least one mold spacer has at least one protrusion extending therefrom into a region between the interior mold portion and the exterior mold portion, wherein said protrusion forms a cavity in the drainage channel for the attachment of a frame or grate assembly.

12. The adjustable mold of claim 7, wherein said first opposing endwall is grooved so as to provide a tongue on the proximal end of the drainage channel, wherein said second opposing endwall has a tongue so as to provide a groove in the distal end of the drainage channel, and wherein each drainage channel has the ability to mate with additional drainage channels using the tongue or groove on the proximal or distal ends of the drainage channel.

13. A method of making drainage channel sections of various sizes, shapes, or slopes, the method comprising:

providing an adjustable mold having an interior mold portion defining a base, a base support that interfaces with said base of said interior mold portion, and an exterior mold portion at least partially surrounding said interior mold portion, wherein the exterior mold portion comprises first and second opposing sidewalls each having a proximal end and a distal end, wherein the first sidewall is coupled to a first portion of the base support, wherein the second sidewall is coupled to a second portion of the base support, and wherein the base support is structured such that the first portion of the base support can move relative to the second portion of the base support to allow the first sidewall to be moved towards or away from the second sidewall, and wherein the exterior mold comprises at least one mold spacer that defines a distance between the exterior mold portion and the interior mold portion and defines the upper edge of at least one wall of the drainage channel sections, the at least one mold spacer defining first and second ends, and wherein the exterior mold portion comprises at least one positioning mechanism structured to allow at least one of the first and second ends of the mold spacer to be positioned at different heights along the exterior mold, wherein the at least one positioning mechanism comprises at least two elongate members extending between the base support and the mold spacer, each of the at least two elongate members being structured such that the length of each elongate member extending between the base support and the mold spacer is adjustable, and wherein the exterior mold portion comprises at least one of the following:

at least one of the elongate members is comprised of a plurality of interlocking, stackable portions; or at least one of the base support and the mold spacer defines an aperture that is structured to threadably receive an end of at least one of the at least two elongate members;

positioning at least one of the first and second ends of the mold spacer at a different height along the exterior mold than the other end;

using the adjustable mold to form a first drainage channel section; and using at least the exterior mold portion from the adjustable mold to form a second drainage channel section having a size, shape, or slope that is different from the first drainage channel section.

14. The method of claim 13, using at least the exterior mold portion from the adjustable mold to form a second drainage channel section further comprises using both the exterior and interior portions of the adjustable mold to form the second drainage channel section having a size, shape, or slope that is different from the first drainage channel section.

* * * * *

UNITED STATES PATENT AND TRADEMARK OFFICE

CERTIFICATE OF CORRECTION

PATENT NO. : 8,517,712 B2
APPLICATION NO. : 12/154052
DATED : August 27, 2013
INVENTOR(S) : Gunter It is certified that error appears in the above-identified patent and that said Letters Patent is hereby corrected as shown below:

Delete the title page and substitute therefore the attached title page showing the corrected number of claims in patent.

In the Claims

Column 12, line 65, after Claim 14, insert the following claims:

--15. The method of claim 13, further comprising:
providing a second interior mold portion that is different from the first interior mold portion, wherein using at least the exterior mold portion from the adjustable mold to form a second drainage channel section further comprises using the second interior mold portion in conjunction with the exterior mold portion instead of the first interior mold portion so that the exterior mold portion at least partially surrounds the second interior mold portion.--

--16. The method of claim 13, wherein using at least the exterior mold portion from the adjustable mold to form a second drainage channel section further comprises moving the first sidewall relative to the second wall so that the second drainage channel has a width that is different from the width of the first drainage channel.--

--17. The method of claim 13, wherein using at least the exterior mold portion from the adjustable mold to form a second drainage channel section further comprises moving the at least one mold spacer relative to the exterior mold portion so that the second drainage channel has a height that is different from the height of the first drainage channel.--

--18. The method of claim 13, wherein using at least the exterior mold portion from the adjustable mold to form a second drainage channel section further comprises changing the slope of the at least one mold spacer relative to the exterior mold portion so that the second drainage channel has a slope that is different from the slope of the first drainage channel.--

Signed and Sealed this
Eighteenth Day of February, 2014

Michelle K. Lee

Michelle K. Lee
*Deputy Director of the United States Patent and Trademark Office*

--19. The method of claim 13, wherein using at least the exterior mold portion from the adjustable mold to form a second drainage channel section further comprises replacing the at least one mold spacer used in the adjustable mold to make the first drainage channel section with at least one mold spacer that is different in size or shape.--

(12) United States Patent
Gunter

(10) Patent No.: US 8,517,712 B2
(45) Date of Patent: Aug. 27, 2013

(54) ADJUSTABLE MOLD AND ASSOCIATED METHOD FOR MAKING A DRAINAGE CHANNEL

(75) Inventor: Charles E. Gunter, Mooresville, NC (US)

(73) Assignee: ABT, Inc., Troutman, NC (US)

( * ) Notice: Subject to any disclaimer, the term of this patent is extended or adjusted under 35 U.S.C. 154(b) by 501 days.

(21) Appl. No.: 12/154,052

(22) Filed: May 20, 2008

(65) Prior Publication Data

US 2009/0290935 A1 Nov. 26, 2009

(51) Int. Cl.
*B28B 7/02* (2006.01)

(52) U.S. Cl.
USPC ..... 425/330; 425/318; 425/DIG. 14; 425/DIG. 25

(58) Field of Classification Search
CPC ..... B28B 7/0044; B28B 7/0079; B28B 7/02
USPC ..... 425/87, 188, 318, 330, DIG. 14, 425/DIG. 25
See application file for complete search history.

(56) References Cited

U.S. PATENT DOCUMENTS

| | | | | |
|---|---|---|---|---|
| 4,630,966 | A * | 12/1986 | Karbstein | 405/118 |
| 5,106,231 | A | 4/1992 | Thomann | |
| 5,281,051 | A | 1/1994 | Stegall | |
| 5,348,421 | A | 9/1994 | Stegall | |
| 5,393,171 | A | 2/1995 | Stegall | |
| 5,482,248 | A | 1/1996 | Connors, Jr. | |
| 5,489,163 | A | 2/1996 | Thomann | |
| 5,653,553 | A | 8/1997 | Gunter | |
| 5,702,204 | A | 12/1997 | Gunter | |
| 5,788,996 | A | 8/1998 | Brouard | |
| 5,890,839 | A | 4/1999 | Gunter | |
| 6,170,796 | B1 | 1/2001 | Gunter | |

(Continued)

FOREIGN PATENT DOCUMENTS

| | | | |
|---|---|---|---|
| DE | 102005008819 | A1 | 9/2006 |
| FR | 2634234 | A1 | 1/1990 |

(Continued)

OTHER PUBLICATIONS

International Search Report for PCT/US2009/044702 dated Jan. 11, 2010.

(Continued)

*Primary Examiner* – Yogendra Gupta
*Assistant Examiner* – Alison Hindenlang
(74) *Attorney, Agent, or Firm* — Moore & Van Allen, PLLC

(57) ABSTRACT

Embodiments of the present invention allow for the manufacture of a number of drainage channels of different heights, widths, thicknesses, shapes, and slopes from only one mold or a greatly-reduced number of molds. In one embodiment, the drainage channel mold has an interior mold and an exterior mold. The exterior mold has two opposing sidewalls that can be placed at different distances apart from one another to vary the overall width of the drainage channel. The sidewalls can be independent of each other or they can be coupled to each other yet still allowed to be positioned at different distances apart. In one embodiment, the sidewalls are hingedly coupled to a base support mechanism. The mold also contains mold spacers that can be located between the interior mold and the exterior mold sidewalls to create different heights, widths, shapes, and slopes in the drainage channel walls formed by the adjustable mold.

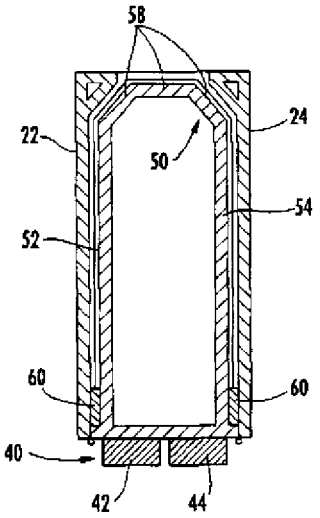

19 Claims, 7 Drawing Sheets